US012421650B2

(12) United States Patent
Traylor

(10) Patent No.: US 12,421,650 B2
(45) Date of Patent: Sep. 23, 2025

(54) LAUNDRY FIXTURE HAVING AN ALUMINUM OUTER COVERING FOR REDUCING STATIC ELECTRICITY WITHIN A LAUNDRY APPLIANCE

(71) Applicant: WHIRLPOOL CORPORATION, Benton Harbor, MI (US)

(72) Inventor: Wesley P. Traylor, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 671 days.

(21) Appl. No.: 17/872,124

(22) Filed: Jul. 25, 2022

(65) Prior Publication Data

US 2023/0055503 A1 Feb. 23, 2023

Related U.S. Application Data

(60) Provisional application No. 63/234,755, filed on Aug. 19, 2021.

(51) Int. Cl.
*D06F 58/20* (2006.01)
*D06F 58/04* (2006.01)

(52) U.S. Cl.
CPC ..... *D06F 58/203* (2013.01); *D06F 58/04* (2013.01)

(58) Field of Classification Search
CPC ..... D06F 58/203; D06F 58/04; D06F 39/024
See application file for complete search history.

(56) References Cited

U.S. PATENT DOCUMENTS

| | | | |
|---|---|---|---|
| 7,441,345 | B2 | 10/2008 | Taylor |
| 8,844,160 | B2 | 9/2014 | Beihoff et al. |
| 10,179,968 | B2 | 1/2019 | Lebrun et al. |
| 2006/0288600 | A1 | 12/2006 | Taylor |
| 2019/0309464 | A1 | 10/2019 | Caswell et al. |
| 2021/0172109 | A1 | 6/2021 | Leibman |

FOREIGN PATENT DOCUMENTS

| | | |
|---|---|---|
| EP | 0095335 A1 | 11/1983 |
| WO | 0132823 | 5/2001 |

*Primary Examiner* — James C Yager
(74) *Attorney, Agent, or Firm* — Price Heneveld LLP

(57) ABSTRACT

A laundry fixture for reducing static electricity includes a substrate. An outer covering includes a woven aluminum fabric that is disposed on the substrate to form a three-dimensional shape. The woven aluminum fabric defining a static-reducing portion. A retaining portion is interspersed within the outer covering to form a particulate-capturing portion. The static-reducing portion and the particulate-capturing portion cooperate to define an entire outer surface of the three-dimensional shape. The three-dimensional shape is configured to be placed within a processing space for a laundry appliance to separate particulate material from articles being processed and retain the particulate material during a laundry cycle.

20 Claims, 5 Drawing Sheets

LAUNDRY FIXTURE HAVING AN ALUMINUM OUTER COVERING FOR REDUCING STATIC ELECTRICITY WITHIN A LAUNDRY APPLIANCE

CROSS-REFERENCE TO RELATED APPLICATION

This application claims priority to and the benefit under 35 U.S.C. § 119(e) of U.S. Provisional Patent Application No. 63/234,755, filed on Aug. 19, 2021, entitled LAUNDRY FIXTURE HAVING AN ALUMINUM OUTER COVERING FOR REDUCING STATIC ELECTRICITY WITHIN A LAUNDRY APPLIANCE, the entire disclosure of which is hereby incorporated herein by reference.

FIELD OF THE DEVICE

The device is generally in the field of laundry appliances, more specifically, a laundry fixture that can be added to a processing space for a laundry appliance to reduce static electricity during use by utilizing an aluminum outer covering that surrounds a three-dimensional substrate.

SUMMARY OF THE DISCLOSURE

According to one aspect of the present disclosure, a laundry fixture for reducing static electricity includes a substrate. An outer covering includes a woven aluminum fabric that is disposed on the substrate to form a three-dimensional shape. The woven aluminum fabric defines a static-reducing portion. A retaining portion is interspersed within the outer covering to form a particulate-capturing portion. The static-reducing portion and the particulate-capturing portion cooperate to define an entire outer surface of the three-dimensional shape. The three-dimensional shape is configured to be placed within a processing space for a laundry appliance to separate particulate material from articles being processed and retain the particulate material during a laundry cycle.

According to another aspect of the present disclosure, a laundry fixture for reducing static electricity includes a substrate. A retaining portion extends outward from the substrate. An outer covering includes a woven aluminum fabric that is disposed over the substrate and on the retaining portion to form a three-dimensional shape. The retaining portion engages the outer covering to maintain a position of the woven aluminum fabric relative to the substrate. The woven aluminum fabric defines a static-reducing portion and the retaining portion is interspersed within the outer covering to form a particulate-capturing portion. The static-reducing portion and the particulate-capturing portion cooperate to define an entire outer surface of the three-dimensional shape. The three-dimensional shape is configured to be placed within a processing space for a laundry appliance to separate particulate material from articles being processed and retain the particulate material during a laundry cycle.

According to yet another aspect of the present disclosure, a laundry fixture for reducing static electricity includes a substrate. A woven outer covering includes a woven fabric made from aluminum. The woven fabric is disposed on the substrate to form a three-dimensional shape, the woven fabric defining a static-reducing portion. A retaining portion is interspersed within the outer covering to form a particulate capturing portion. The static-reducing portion and the particulate capturing portion cooperate to define an entire outer surface of the three-dimensional shape, wherein the three-dimensional shape is configured to be placed within a processing space for a laundry appliance to separate particulate material from articles being processed and retain the particulate material during a laundry cycle.

These and other features, advantages, and objects of the present disclosure will be further understood and appreciated by those skilled in the art by reference to the following specification, claims, and appended drawings.

Figure 1:
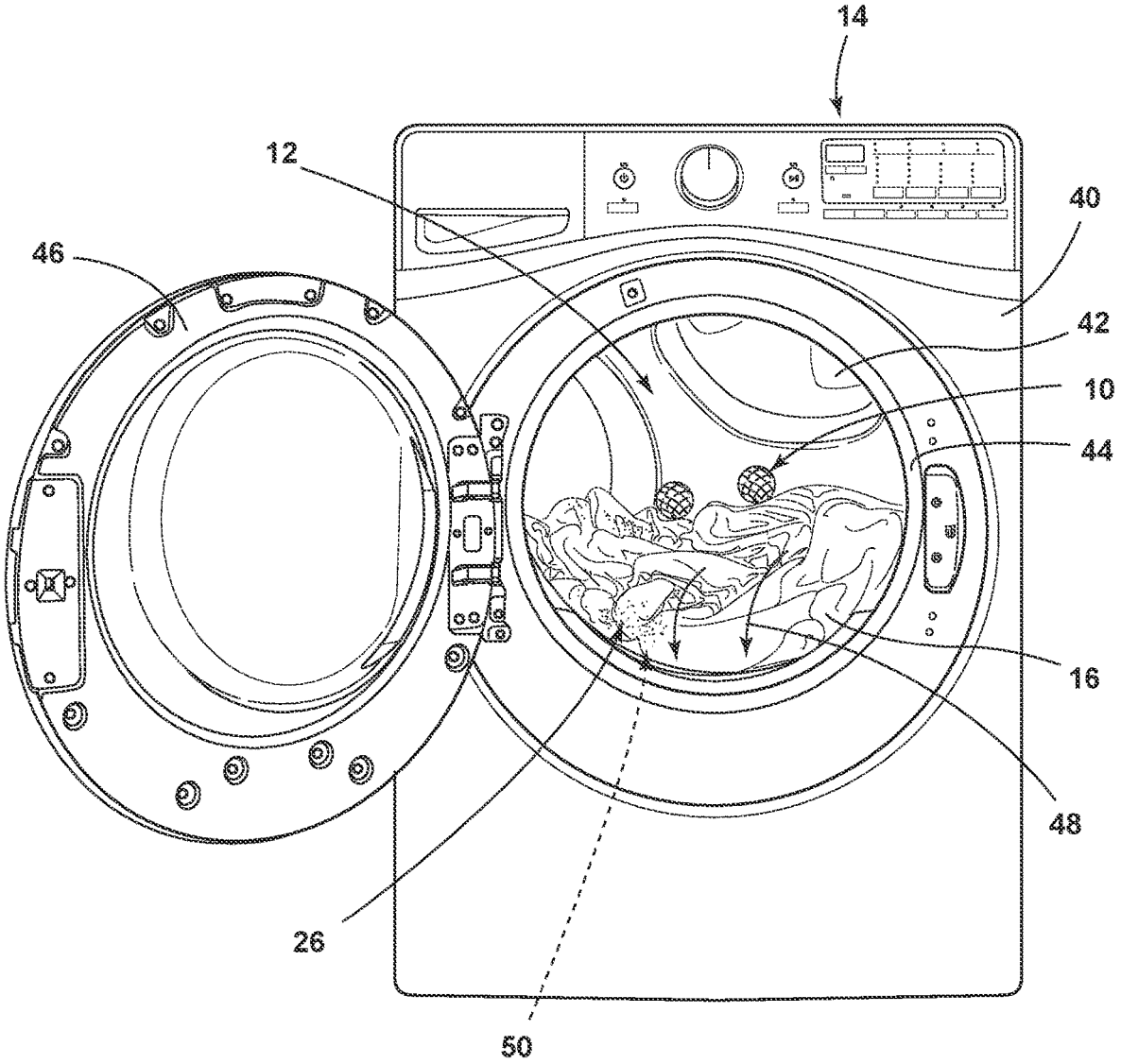
FIG. 1 is a front elevational view of a laundry appliance shown with a door in an open position.
Figure 2:
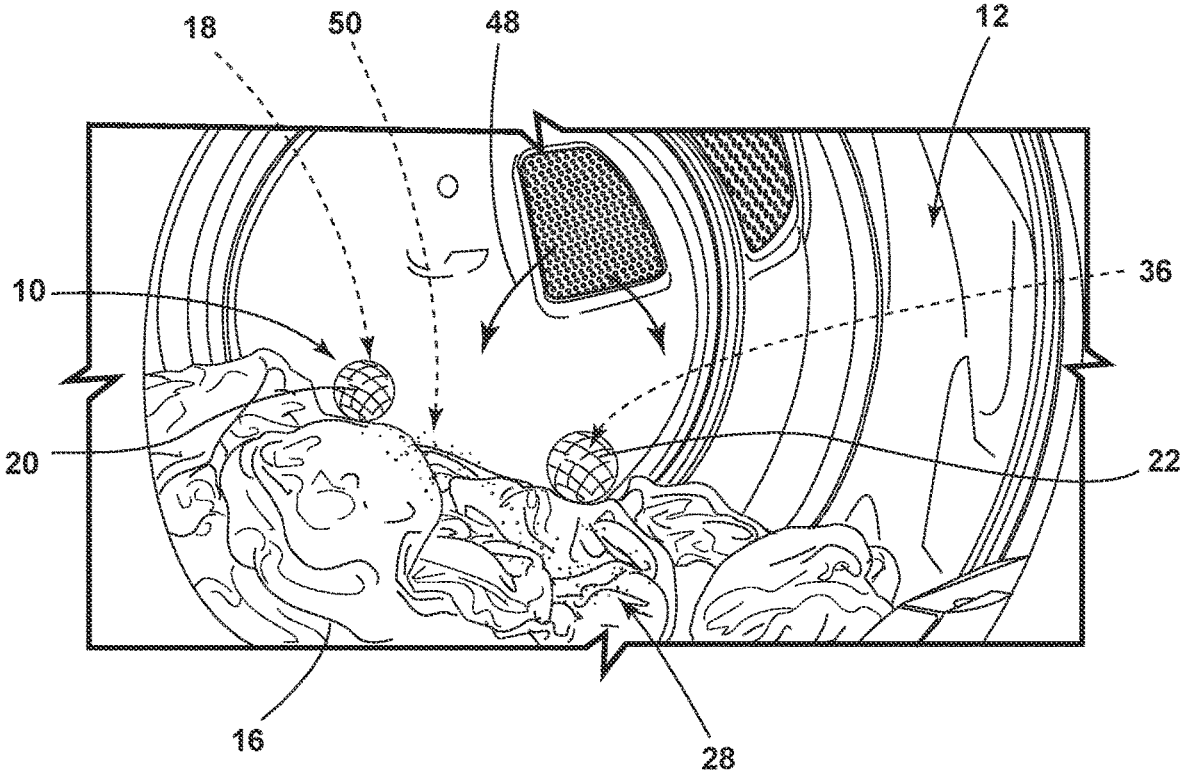
FIG. 2 is an interior perspective view of a processing space for a laundry appliance and showing an aspect of the laundry fixture interacting with laundry articles.

The components in the figures are not necessarily to scale, emphasis instead being placed upon illustrating the principles described herein.

DETAILED DESCRIPTION

The present illustrated embodiments reside primarily in combinations of method steps and apparatus components related to a methods, steps and apparatus components related to a laundry appliance fixture for use within a processing space of a laundry appliance for decreasing static electricity within articles being processed using a woven aluminum fabric covering that extends around a three-dimensional substrate. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIGS. 1-5, reference numeral 10 generally refers to a laundry fixture that can be used within the processing space 12 of a laundry appliance 14 for reducing static electricity 50 within articles 16 being processed. According to various aspects of the device, the laundry fixture 10 includes a substrate 18 and an outer covering 20 that includes a woven aluminum fabric 22 that is disposed on the substrate 18 to form a three-dimensional shape. The woven aluminum fabric operates as a static-reducing portion 30 of the outer covering. Typically, the three-dimensional shape of the laundry fixture 10 will be in the form of a substrate 18 with the outer covering 20 extending over the substrate 18. A retaining portion 24 of the laundry fixture 10 is interspersed with the outer covering 20 to form a particulate-capturing portion 32 of the outer surface for the laundry fixture. The retaining portion 24 operates during performance of a laundry cycle to separate particulate material 26 from articles 16 being processed and to retain that particulate material 26 during the performance of a particular laundry cycle. The static-reducing portion 30 and the particulate-capturing portion 32 cooperate to define the entire outer surface or substantially all of the outer surface of the three-dimensional shape.

According to various aspects of the device, the laundry fixture 10 is typically used within laundry dryers, or laundry appliances having a drying function. These appliances 14 typically include an outer cabinet 40 and a rotating drum 42 that is positioned within the outer cabinet 40. An aperture 44 within the outer cabinet 40 provides access to the processing space 12 within the rotating drum 42. A door 46 is used to selectively enclose the processing space 12 during the performance of a particular laundry cycle. During a laundry cycle, articles 16 being processed are rotated within the rotating drum 42 and process air 48 is moved through the rotating drum 42. During this laundry cycle, process air 48 dehumidifies the articles 16 being processed and removes moisture from the processing space 12. Typically, it is common for static electricity 50 to increase over the course of the laundry cycle. As the rotating drum 42 operates, the articles 16 being processed intermingle with one another. This intermingling of fabrics causes an exchange of electrons between materials that increases the static electricity 50 within the processing space 12 and between the various articles 16. This static electricity 50 causes the articles 16 being processed to stick to one another and can result in a general inconvenience when taking the articles 16 out of the rotating drum 42 and when performing later laundry steps, such as folding and putting the articles 16 away. The presence of static electricity 50 can also result in pet hair 28 being attracted to and adhering to the articles 16 being processed in the drum 42.

The use of the laundry fixture 10 described herein provides a woven aluminum fabric 22 that can mitigate the occurrence and lessen the effect of static electricity 50 within pet hair 28 and the articles 16 being processed within the processing drum 42. Aluminum is known to be a material that absorbs free electrons from the articles 16 being processed and prevents these electrons from being accumulated within other articles 16. This characteristic of aluminum reduces the occurrence of static electricity 50 during the performance of a laundry cycle. By placing the woven aluminum fabric 22 over the substrate 18, the laundry fixture 10 can intermingle with the articles 16 being processed to prevent the occurrence of static electricity 50 before any static charge can be formed within the processing space 12. The laundry article 16 having the woven aluminum fabric 22 can also lessen the electrostatic attraction between pet hair 28 and the articles 16 being processed. In certain aspects of the device, the woven aluminum fabric can be in the form of aluminum strips or strands or other similar form of aluminum bands 62 that are woven together. The aluminum bands 62 can also be used to form composite strands 64 and other members that are made of aluminum and other materials can also be used to form the woven aluminum fabric.

Referring again to FIGS. 1-6, the outer covering 20 can include aluminum and wool that are woven together to form the woven aluminum fabric 22. In this manner, the woven aluminum fabric 22 can include flexible aluminum bands 62 that are woven to form a woven fabric structure 60. These flexible aluminum bands 62 can be formed with other flexible aluminum bands 62 so that the outer covering 20 is entirely made of aluminum.

In certain aspects of the device, the woven aluminum fabric 22 can include flexible aluminum bands 62 that are woven in one direction and wool members 66 or other flexible members that are woven in a generally perpendicular direction. In this manner, the woven aluminum fabric 22 can include a warp 70 and weft 72 that are woven together to form the woven fabric structure 60. Typically, the warp 70 of the fabric structure 60 will include the flexible aluminum bands 62. The weft 72 of the fabric structure 60 can include flexible aluminum bands 62 as well as other materials that can be used to form the flexible aluminum fabric 22. Such materials of the weft 72 can include, but are not limited to, wool, plastic, other fabric-type materials, aluminum, and other materials that can be used to form the retaining portion 24, as will be described more fully herein. Typically, the warp 70 and the weft 72 are arranged in a generally perpendicular arrangement or weaving pattern to form the fabric structure 60.

Referring again to FIGS. 3-5, the retaining portion 24 of the laundry fixture 10 can include at least one of a sticky surface or tacky surface that operates at a retaining surface 80 of a retaining structure 82 that secures the particulate material 26 to the outer covering 20 or to an exposed portion of the substrate 18. This retaining surface 80 can be in the form of a weft 72 that is woven with the flexible aluminum bands 62 to form the fabric structure 60.

The retaining portion 24 of the laundry fixture 10 can also include retaining structures 82 that extend from the substrate 18 and through gaps 90 in the woven aluminum fabric 22. These retaining structures 82 can be used to hold down the woven aluminum fabric 22 and secure this fabric structure 60 in place near the substrate 18. It is also contemplated that the retaining structures 82 included within the substrate 18 can serve as the retaining portion 24 that helps to capture and retain particulate material 26 from articles 16 being processed within the processing space 12 of the appliance 14.

Referring again to FIGS. 3-6, the outer covering 20 and the woven aluminum fabric 22 can include aluminum fibers that are woven together to form a flexible aluminum mesh structure 100. Various retaining surfaces 80 and retaining structures 82 can be exposed through the gaps 90 in the flexible aluminum mesh structure 100. It is also contemplated that the retaining surfaces 80 of the retaining portion 24 can be interwoven with the flexible aluminum mesh structure 100.

It is also contemplated that the woven aluminum fabric 22 can be made of a plurality of composite strands 64 that are woven together to form the woven aluminum fabric 22. The composite strands 64 can be made of aluminum bands 62 or other aluminum members that are intertwined with another material, such as wool members 66. These composite strands 64 can then be woven together to form a composite woven structure 104 that forms at least a portion of the outer covering for the laundry fixture 10. These composite strands 64 that form the composite woven structure 104 can be used as a multi-function structure that can help to reduce the presence of static in the processing space 12, and also help to retain particulate material 26 from articles 16 being processed within the processing space 12 of the appliance 14.

Referring again to FIGS. 1-5, the substrate 18 for the laundry fixture 10 can include a three-dimensional structure that can be made of various materials. In at least one exemplary aspect of the device, the substrate 18 can be a wool ball 110 that can have the woven aluminum fabric 22 positioned around the wool ball 110. The wool ball 110 can be in the form of a generally rigid structure or a plush structure. The substrate 18 can also be in the form of a more rigid plastic or elastomeric structure that can be used to retain the woven aluminum fabric 22 as the outer covering 20 for the laundry fixture 10.

Figure 3:
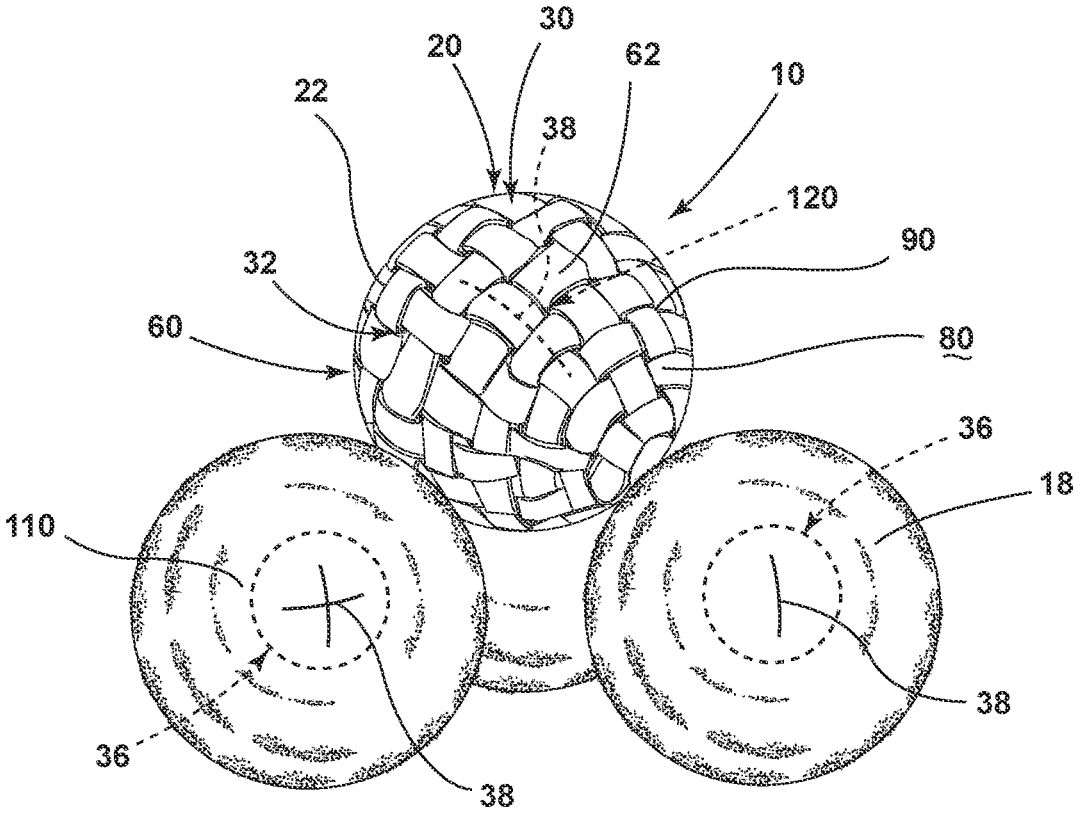
FIG. 3 is a perspective view of an exemplary aspect of the laundry fixture and showing a configuration of the outer covering that surrounds the substrate.
Figure 4:
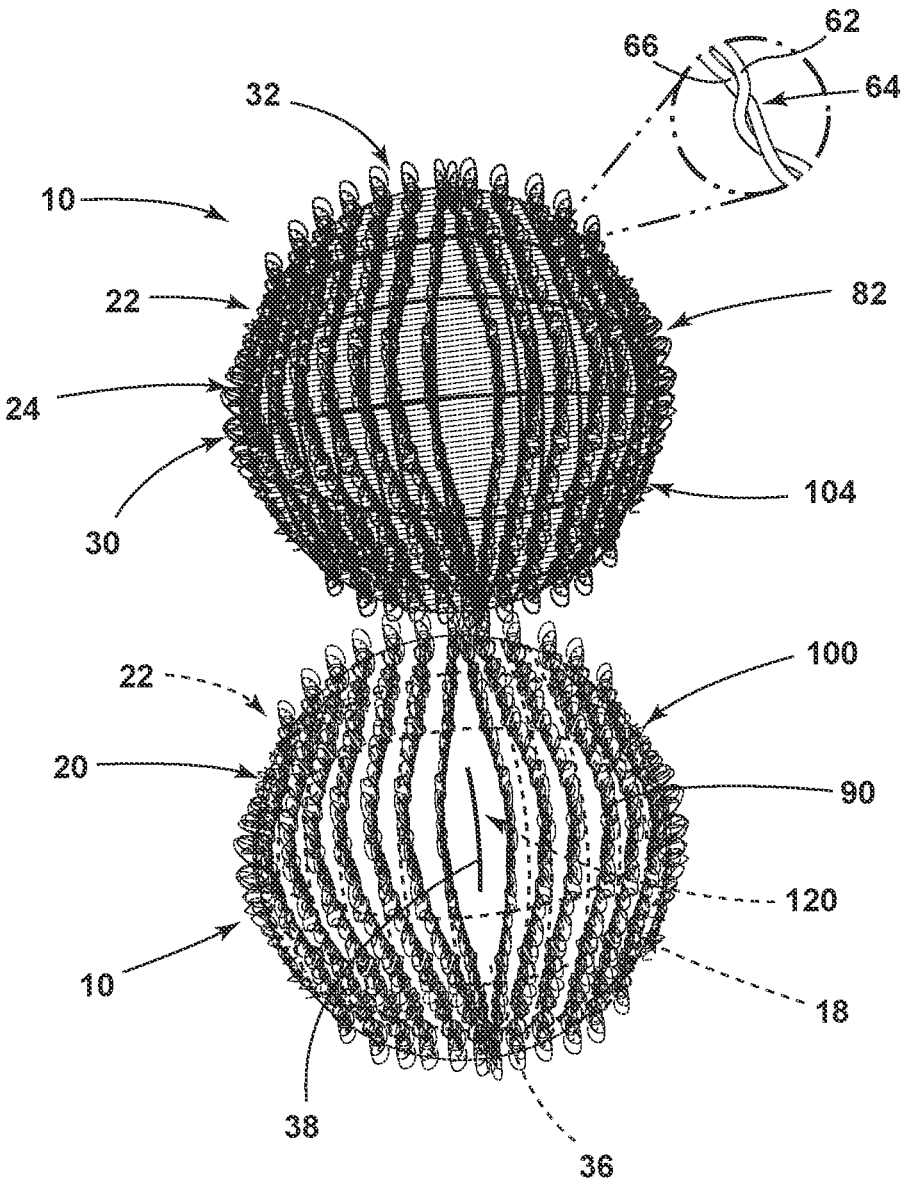
FIG. 4 is a perspective view of an exemplary aspect of the laundry fixture and showing a retaining portion that extends outward from the outer covering to retain particulate matter released from laundry articles being processed.
Figure 5:
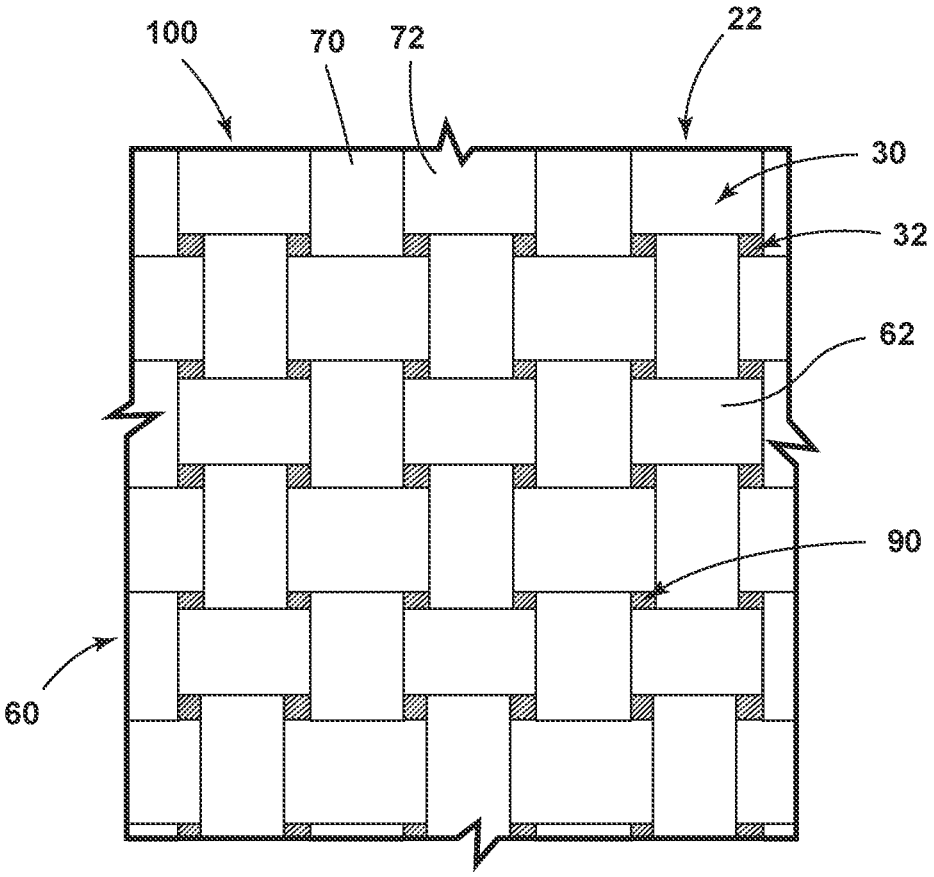
FIG. 5 is an exemplary schematic representation of the woven aluminum fabric.

In certain aspects of the device, as exemplified in FIGS. 3 and 4, the substrate 18 can include an accessible interior 36 in the form of a fragrance portion or other portion that can be used to contain and release, over time, fragrancing materials, softening materials, and other similar laundry chemistries that can be used to assist in processing the articles 16 within the laundry appliance 14. The substrate 18 can include the accessible interior 36 that is accessible through one or more slits 38 in the substrate 18 for depositing various laundry chemistries within the laundry fixture 10 and also for releasing these laundry chemistries during a laundry cycle. These chemistries can be released from the accessible interior 36 through the slits 38 and the outer covering 20. This accessible interior 36 can also be accessed via the slits 38 and a movable portion 120, such as rotating panels, elastic features, or other similar openings, that can be used for accessing an interior of the substrate 18 through the outer covering 20 and the retaining portion 24.

According to various aspects of the device, the laundry fixture 10 can be inserted within the processing space 12 for the appliance 14 and kept there for an extended period of time. Stated another way, the laundry fixture 10 can be placed within the processing space 12 and can be maintained within the processing space 12 over the performance of a number of laundry cycles. Over time, it is contemplated that the retaining portion 24 of the laundry fixture 10 will accumulate certain amounts of particulate material 26, such as pet hair 28, during performance of various laundry cycles.

Certain laundry cycles may contain larger amounts of particulate material 26, typically in the form of pet hair 28 and pet dander that can accumulate on clothing during use. During a laundry cycle, this pet hair 28 attaches to the articles 16 being processed through electrostatic conditions that are typically present within the pet hair 28. The use of the laundry fixture 10 having the woven aluminum fabric 22 retains these electrons that may be present within the pet hair 28. By diminishing the presence and effect of the free electrons, the occurrence of static electricity 50 can be mitigated.

By removing or mitigating the static electricity 50, the pet hair 28 is able to be more conveniently removed through the use of the retaining portion 24 of the laundry fixture 10. As the laundry fixture 10 intermingles with the articles 16 being processed, the retaining portion 24 can capture and retain particulate material 26, including pet hair 28. In addition, by removing or mitigating the electrostatic characteristics of the pet hair 28, the pet hair 28 is more able to freely move with the process air 48. Accordingly, the pet hair 28 is able to be delivered by process air 48 away from the processing space 12 and into an airflow path. When moved to the airflow path, the pet hair 28 and other particulate material 26 can be captured by a particulate filter of the appliance 14.

At the conclusion of the laundry cycle, the laundry fixture 10 can be removed from the articles 16 being processed and the various pet hair 28 and particulate material 26 can be removed from the laundry fixture 10. Once the pet hair 28 and particulate material 26 is removed, the laundry fixture 10 can be replaced into the laundry appliance 14 for use during the next laundry cycle.

It is contemplated that the laundry fixture 10 can be any one of various three-dimensional shapes. These shapes can include, but are not limited to, spherical, polygonal, irregular prism, and other similar shapes. It is also contemplated that the laundry fixture 10 can be made into a three-dimensional shape of a theme or toy shape, such as a bone, plush toy, or other similar three-dimensional shape.

According to various aspects of the device, the outer covering 20 can be removed from the substrate 18 and replaced after cleaning. The fabric structure 60 of the outer covering 20 having the warp 70 and the weft 72 can be utilized for including an elastic functionality to the outer covering 20 to define a movable portion 120 of the outer covering 20. This movable portion 120 can be stretched, moved, or otherwise manipulated to expose and access the accessible interior 36 of the substrate 18. The weft 72 of the fabric structure 60 can be in the form of a flexible or elastic material that can stretch while the aluminum of the warp 70 is generally a static and less flexible material. When the fabric structure 60 having the movable portion 120 is moved over and away from the substrate 18, the various pet hair 28 and particulate matter can be removed from the outer covering 20. Once removed, the outer covering 20, using the movable portion 120, can be replaced onto the substrate 18 for use in a subsequent laundry cycle.

According to another aspect of the present disclosure, a laundry fixture for reducing static electricity includes a substrate. An outer covering includes a woven aluminum fabric that is disposed on the substrate to form a three-dimensional shape. The woven aluminum fabric defines a static-reducing portion. A retaining portion is interspersed within the outer covering to form a particulate-capturing portion. The static-reducing portion and the particulate-capturing portion cooperate to define an entire outer surface of the three-dimensional shape. The three-dimensional shape is configured to be placed within a processing space for a laundry appliance to separate particulate material from articles being processed and retain the particulate material during a laundry cycle.

According to another aspect, the outer covering includes aluminum strips that are woven together to form the woven aluminum fabric.

According to yet another aspect, the retaining portion includes a sticky surface that selectively secures the particulate material to the outer covering.

According to another aspect of the present disclosure, the retaining portion includes a retaining structure that selectively secures the particulate material to the outer covering.

According to another aspect, the woven aluminum fabric includes flexible aluminum bands that are woven together to form a fabric structure.

According to yet another aspect, the woven aluminum fabric includes aluminum members and wool members that are intertwined into composite strands. The composite strands are woven together to define the outer covering.

According to another aspect of the present disclosure, the substrate includes retaining structures that extend through the woven aluminum fabric to position the woven aluminum fabric relative to the substrate.

According to another aspect, the retaining structures at least partially define the retaining portion.

According to yet another aspect, the woven aluminum fabric includes aluminum fibers that are woven together to form a flexible aluminum mesh structure.

According to another aspect of the present disclosure, the retaining portion extends through gaps defined within the flexible aluminum mesh structure.

According to another aspect, the retaining portion is defined by a separate material that is interwoven with the flexible aluminum mesh structure.

According to another aspect, the retaining portion is defined by a portion of the substrate that is exposed through the outer covering.

According to yet another aspect, a laundry fixture for reducing static electricity includes a substrate. A retaining portion extends outward from the substrate. An outer covering includes a woven aluminum fabric that is disposed over the substrate and on the retaining portion to form a three-dimensional shape. The retaining portion engages the outer covering to maintain a position of the woven aluminum fabric relative to the substrate. The woven aluminum fabric defines a static-reducing portion and the retaining portion is interspersed within the outer covering to form a particulate-capturing portion. The static-reducing portion and the particulate-capturing portion cooperate to define an entire outer surface of the three-dimensional shape. The three-dimensional shape is configured to be placed within a processing space for a laundry appliance to separate particulate material from articles being processed and retain the particulate material during a laundry cycle.

According to another aspect of the present disclosure, the substrate is made of wool.

According to another aspect, the substrate includes an accessible interior for disposing a laundry chemistry.

According to yet another aspect, the woven aluminum fabric of the outer covering includes a warp that extends around the substrate and a weft that is interwoven with the warp in a generally perpendicular arrangement.

According to another aspect of the present disclosure, the warp is made from strips of aluminum and the weft is made from an elastic material.

According to another aspect, the weft defines a movable portion of the outer covering that is operable to define an aperture through the outer covering to access the accessible interior of the substrate.

According to yet another aspect, a laundry fixture for reducing static electricity includes a substrate. A woven outer covering includes a woven fabric made from aluminum. The woven fabric is disposed on the substrate to form a three-dimensional shape, the woven fabric defining a static-reducing portion. A retaining portion is interspersed within the outer covering to form a particulate capturing portion. The static-reducing portion and the particulate capturing portion cooperate to define an entire outer surface of the three-dimensional shape, wherein the three-dimensional shape is configured to be placed within a processing space for a laundry appliance to separate particulate material from articles being processed and retain the particulate material during a laundry cycle.

According to another aspect of the present disclosure, the retaining portion is interwoven with the woven fabric of the woven outer covering.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry fixture for reducing static electricity, the laundry fixture comprising:

a substrate;

an outer covering that includes a woven aluminum fabric that is disposed on the substrate to form a three-dimensional shape, the woven aluminum fabric defining a static-reducing portion; and a retaining portion that is interspersed within the outer covering to form a particulate-capturing portion, wherein the static-reducing portion and the particulate-capturing portion cooperate to define an entire outer surface of the three-dimensional shape, wherein the three-dimensional shape is configured to be placed within a processing space for a laundry appliance to separate particulate material from articles being processed and retain the particulate material during a laundry cycle.

2. The laundry fixture of claim 1, wherein the outer covering includes aluminum strips that are woven together to form the woven aluminum fabric.

3. The laundry fixture of claim 1, wherein the retaining portion includes a sticky surface that selectively secures the particulate material to the outer covering.

4. The laundry fixture of claim 1, wherein the retaining portion includes a retaining structure that selectively secures the particulate material to the outer covering.

5. The laundry fixture of claim 1, wherein the woven aluminum fabric includes flexible aluminum bands that are woven together to form a fabric structure.

6. The laundry fixture of claim 1, wherein the woven aluminum fabric includes aluminum members and wool members that are intertwined into composite strands, wherein the composite strands are woven together to define the outer covering.

7. The laundry fixture of claim 1, wherein the substrate includes retaining structures that extend through the woven aluminum fabric to position the woven aluminum fabric relative to the substrate.

8. The laundry fixture of claim 7, wherein the retaining structures at least partially define the retaining portion.

9. The laundry fixture of claim 7, wherein the woven aluminum fabric includes aluminum fibers that are woven together to form a flexible aluminum mesh structure.

10. The laundry fixture of claim 9, wherein the retaining portion extends through gaps defined within the flexible aluminum mesh structure.

11. The laundry fixture of claim 9, wherein the retaining portion is defined by a separate material that is interwoven with the flexible aluminum mesh structure.

12. The laundry fixture of claim 1, wherein the retaining portion is defined by a portion of the substrate that is exposed through the outer covering.

13. A laundry fixture for reducing static electricity, the laundry fixture comprising:

a substrate;

a retaining portion that extends outward from the substrate; and an outer covering that includes a woven aluminum fabric that is disposed over the substrate and on the retaining portion to form a three-dimensional shape, wherein the retaining portion engages the outer covering to maintain a position of the woven aluminum fabric relative to the substrate, and wherein the woven aluminum fabric defines a static-reducing portion and the retaining portion is interspersed within the outer covering to form a particulate-capturing portion, wherein the static-reducing portion and the particulate-capturing portion cooperate to define an entire outer surface of the three-dimensional shape, and wherein the three-dimensional shape is configured to be placed within a processing space for a laundry appliance to separate particulate material from articles being processed and retain the particulate material during a laundry cycle.

14. The laundry fixture of claim 13, wherein the substrate is made of wool.

15. The laundry fixture of claim 13, wherein the substrate includes an accessible interior for disposing a laundry chemistry.

16. The laundry fixture of claim 15, wherein the woven aluminum fabric of the outer covering includes a warp that extends around the substrate and a weft that is interwoven with the warp in a generally perpendicular arrangement.

17. The laundry fixture of claim 16, wherein the warp is made from strips of aluminum and the weft is made from an elastic material.

18. The laundry fixture of claim 17, wherein the weft defines a movable portion of the outer covering that is operable to define an aperture through the outer covering to access the accessible interior of the substrate.

19. A laundry fixture for reducing static electricity, the laundry fixture comprising:

a substrate;

a woven outer covering that includes a woven fabric made from aluminum, wherein the woven fabric is disposed on the substrate to form a three-dimensional shape, the woven fabric defining a static-reducing portion; and a retaining portion that is interspersed within the outer covering to form a particulate capturing portion, wherein the static-reducing portion and the particulate capturing portion cooperate to define an entire outer surface of the three-dimensional shape, wherein the three-dimensional shape is configured to be placed within a processing space for a laundry appliance to separate particulate material from articles being processed and retain the particulate material during a laundry cycle.

20. The laundry fixture of claim 19, wherein the retaining portion is interwoven with the woven fabric of the woven outer covering.

* * * * *